US007350869B2

(12) United States Patent
Davidson

(10) Patent No.: US 7,350,869 B2
(45) Date of Patent: Apr. 1, 2008

(54) CHAIR

(76) Inventor: Jennifer Anne Davidson, 28 Cherry St., Warrawee, NSW (AU) 2074

( * ) Notice: Subject to any disclaimer, the term of this patent is extended or adjusted under 35 U.S.C. 154(b) by 0 days.

(21) Appl. No.: 10/563,006

(22) PCT Filed: Jun. 22, 2004

(86) PCT No.: PCT/AU2004/000818

§ 371 (c)(1),
(2), (4) Date: May 23, 2006

(87) PCT Pub. No.: WO2004/112544

PCT Pub. Date: Dec. 29, 2004

(65) Prior Publication Data

US 2007/0096534 A1 May 3, 2007

(30) Foreign Application Priority Data

Jun. 25, 2003 (AU) ..... 2003903213

(51) Int. Cl.
*A47C 7/14* (2006.01)

(52) U.S. Cl. ..... 297/452.27; 297/284.1; 297/284.3

(58) Field of Classification Search ..... 297/284.1, 297/284.3, 452.27
See application file for complete search history.

(56) References Cited

U.S. PATENT DOCUMENTS

| | | | | |
|---|---|---|---|---|
| 2,047,616 | A | 7/1936 | Church | |
| 3,511,537 | A | 5/1970 | Ackerman | |
| 4,236,751 | A | 12/1980 | Strien | |
| 4,837,881 | A * | 6/1989 | Kondo et al. | 297/452.27 X |
| 5,352,023 | A * | 10/1994 | Jay et al. | 297/284.1 X |
| 5,390,384 | A * | 2/1995 | Dinsmoor et al. | 297/452.27 X |
| 5,414,884 | A * | 5/1995 | Mackenzie | 297/284.1 X |
| 5,433,505 | A * | 7/1995 | Coyne et al. | 297/284.1 |
| 5,950,263 | A * | 9/1999 | Hanson et al. | 297/452.27 X |
| 6,003,949 | A * | 12/1999 | Rinne et al. | 297/284.3 X |
| 6,079,782 | A * | 6/2000 | Berg et al. | 297/284.3 |
| 6,086,151 | A * | 7/2000 | Vanharanta | 297/284.1 |
| 6,099,075 | A * | 8/2000 | Watkins | 297/284.1 |
| 6,123,390 | A | 9/2000 | Greenwald | |
| 6,319,585 | B1 * | 11/2001 | Coronado | 297/284.1 X |
| 6,336,681 | B1 * | 1/2002 | Crosbie | 297/452.27 |
| 6,625,830 | B2 * | 9/2003 | Lampel | 297/452.27 X |
| 2003/0001422 | A1 | 1/2003 | Toyota et al. | |

FOREIGN PATENT DOCUMENTS

| | | |
|---|---|---|
| AU | 585714 | 11/1987 |
| AU | 596184 | 12/1987 |
| AU | 40110/89 | 3/1990 |

(Continued)

*Primary Examiner*—Rodney B. White
(74) *Attorney, Agent, or Firm*—Townsend and Townsend and Crew, LLP

(57) ABSTRACT

A chair (1), including a seat (5), wherein the seat (5) includes a barrier zone (10) dividing said seat (5) into a front seat portion (15) and a rear seat portion (20), said rear seat portion (20) being of a material more easily deformed than said barrier zone (10), such that in use, movement of the user's buttocks from said rear seat portion (20) towards said front seat portion (15) urges the rear seat portion (20) towards said barrier zone (10), deforming said rear seat portion (20) and inhibiting said buttocks from moving towards said front seat portion (15).

6 Claims, 2 Drawing Sheets

FOREIGN PATENT DOCUMENTS

| | | | | |
|---|---|---|---|---|
| AU | 747131 | B2 | 11/1999 | |
| AU | 2002300321 | B2 | 12/2002 | |
| CA | 2135664 | C | 5/1995 | |
| DE | 2630267 | A | 1/1978 | |
| DE | 4300602 | A1 | 7/1994 | |
| EP | 0099236 | A2 | 1/1984 | |
| EP | 0130169 | A1 | 1/1985 | |
| FR | 2703227 | A1 * | 10/1994 | ..... 297/452.27 |
| GB | 2182241 | A | 5/1987 | |
| GB | 2393420 | A | 3/2004 | |
| JP | 2002-46513 | A | 2/2002 | |
| JP | 2004-184035/18 | A | 10/2003 | |
| WO | WO 9300029 | A1 * | 1/1993 | ..... 297/452.27 |
| WO | WO 96/04878 | A1 | 2/1996 | |
| WO | WO 96/12425 | A1 | 5/1996 | |
| WO | WO 99/63868 | A1 | 12/1999 | |

* cited by examiner

CHAIR

FIELD OF THE INVENTION

The present invention relates to chairs and, in particular, to a chair which actively supports good posture.

BACKGROUND OF THE INVENTION

The human body is not well designed for sitting for prolonged periods, yet modern work patterns and lifestyles require us to do just that. When seated, most of the body weight is supported on two pointed bones which form the base of the pelvis. These bones are known as the ischial tuberosities. In the seated state, the pelvis is inherently unstable—it is rather like a triangle balanced on its point.

When seated, the weight of the body trunk, supported by the spine, tends to rotate the pelvis backwards, pushing the spine into a c-shaped curve known as kyphosis. The buttocks then tend to slide forward on the seat, reinforcing the c-curve in the spine.

If the spine is in kyphosis, pressures within the discs of the spine increase very markedly, which will lead to degenerative changes over time, potentially causing severe pain. In addition, with the spine in kyphosis, the rib cage cannot readily expand, nor can the diaphragm move downwards fully. Hence, respiratory efficiency is greatly reduced, which in turn affects many body functions dependent upon blood oxygen levels.

Good posture is important because it minimizes the risk of back pain and improves respiratory efficiency. Various approaches to chair design have been adopted with the aim of encouraging correct seating posture.

These existing designs include the "kneel" chair, popular in the 1970's and 1980's, which supports the buttocks on a surface inclined forward at approximately 30 degrees and prevents the user sliding forward by taking part of the body weight on a knee pad in front of and below the main seating surface. This chair attempts to encourage sound posture initially, but imposes significant load on the knees, which can lead to pain over time. In addition, because no support is provided for the trunk, the user's muscles are constantly in use to stabilize the trunk, which can lead to fatigue over time.

A further example is the "Bambach" saddle chair, which provides a seat member most readily described as a cross between a horse saddle and a bicycle saddle. The user sits astride the seat member. A back support is provided as an option. Like any saddle, this type of seat member causes pressure and chafing and is uncomfortable for females wearing a skirt in particular.

Australian Patent Application No. 73415/87 discloses the "Dual Density" chair. This chair seeks to prevent the pelvis rotating and sliding forward by allowing the ischial tuberosities to become embedded in a soft rear section of the seat cushion and attempts to prevent forward movement by providing a firmer material at the front of the seat, creating a transverse discontinuity, or "split" across the seat. This chair has the disadvantage that the firmer front section of the seat is uncomfortable and exerts pressure on the back of the user's thighs, with possible impedance of peripheral blood circulation in that area.

Further, Australian Patent Application No. 29072/99 discloses the "Soft Cell" chair. This chair seeks to address the disadvantage of the dual density seat in circulatory terms. This is attempted by making the chair seat softer at the front and harder at the back of the seat surface. This chair does not support good posture and performs no differently than a standard foam seat cushion in ergonomic terms.

Another chair design is the "Nottingham" chair, which is designed to allow seating over a wide range of working heights, to allow users of varying stature to address a range of working surface heights comfortably. It attempts to address the issue of spinal stability and correct postural curvature by opening up the angle between the trunk and thighs by encouraging the user to adopt a higher seat height.

Lastly, the "Kneeshaw" chair seeks to maintain pelvic (and hence spinal) alignment by lodging the ischial tuberosities in a depression at the rear edge of the seat cushion.

Accordingly, there is a need to provide a chair that provides good posture and user comfort without the disadvantages of load or pressure on inappropriate areas of the body, such as knees or thighs, and that does not include complex upholstery configurations, such as those which may pose hygiene problems by the accumulation of dirt, for example.

The above statements regarding prior disclosures are not to be taken to be admissions of what was well known in the field of chairs.

SUMMARY OF THE INVENTION

It is an object of the present invention to overcome or ameliorate some of the disadvantages of the prior art, or at least to provide a useful alternative.

There is firstly disclosed herein a chair, including a seat, wherein the seat includes a barrier zone dividing the seat into a front seat portion and a rear seat portion, the rear seat portion being of a material more easily deformed than the barrier zone, such that in use, movement of a user's buttocks from the rear seat portion towards the front seat portion urges the rear seat portion towards the barrier zone, deforming the rear seat portion and inhibiting the buttocks from moving towards the front seat portion.

Preferably, the barrier zone is of a material having a higher density than the rear seat portion material.

Preferably, the front and rear seat portions are of the same density.

Preferably, the barrier zone is located between 25% to 60% along a length of the seat when measured from a back edge of the seat to a front edge of the seat.

Preferably, the barrier zone is a ridge extending longitudinally completely across a width of the seat.

Preferably, the barrier zone is a ridge extending longitudinally partially across a width of the seat.

Preferably, the barrier zone is a molded part of the seat.

Preferably, the barrier zone is 40 to 100 mm wide.

Preferably, the barrier zone is located below a top surface of the seat.

BRIEF DESCRIPTION OF THE DRAWINGS

A preferred embodiment of the invention will now be described, by way of example only, with reference to the accompanying drawings.

DETAILED DESCRIPTION OF THE PREFERRED EMBODIMENTS

Figure 1:
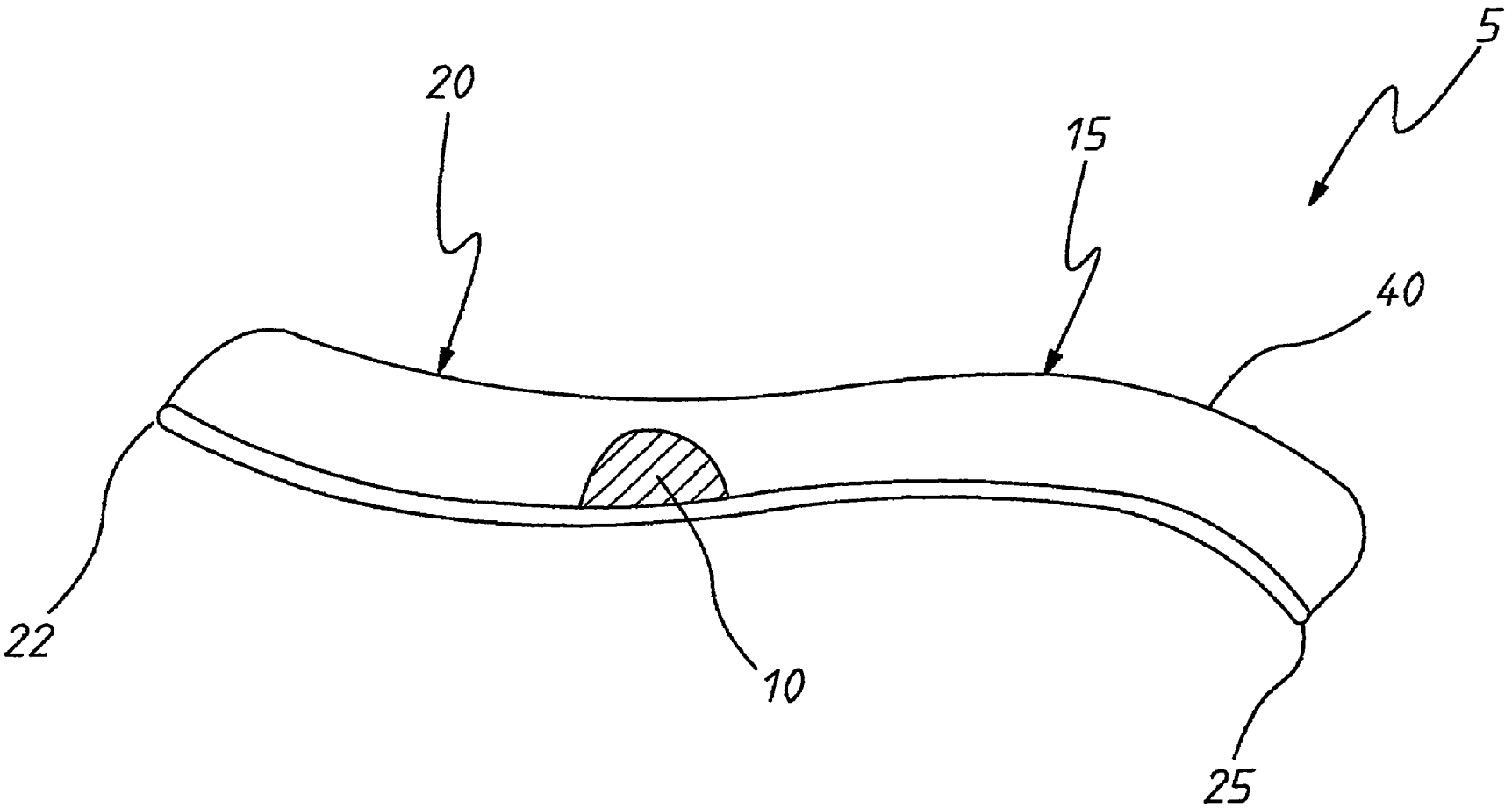
FIGS. 1 and 2 show seats of embodiments of the present invention.

In the accompanying drawings, there is schematically depicted a chair 1 including a seat 5 including a barrier zone 10 dividing the seat 5 into a front seat portion 15 and a rear seat portion 20. The rear seat portion 20 is of a material more easily deformed than the barrier zone 10, such that in use, movement of a user's buttocks from the rear seat portion 20 towards the front seat portion 15 urges the rear seat portion 20 towards the barrier zone 10 deforming the rear seat portion 20 and inhibiting the buttocks from moving towards the front seat portion 15.

The barrier zone 10 or "speed bump" should be of a material having a higher density than the material of the front and rear seat portions 15, 20. The barrier zone 10 is a ridge which extends longitudinally, either completely or partially across the width of the seat 5. In the preferred form, the ridge 10 would be approximately 40 to 100 mm wide and located between 25% to 60% along the length of the seat 5 when measured from the back edge 22 of the seat 5 to the front edge 23 of the seat 5. It is also possible that the ridge 10 be integrally formed or a molded part of the base 25 of the seat 5.

This configuration advantageously promotes good posture and user comfort without the disadvantages of load or pressure on inappropriate areas of the body such as knees or thighs and without the need for complex upholstery configurations which increase manufacturing costs and complexity of construction and can pose a potential hygiene problem by trapping dirt and other unwanted materials. The chair 1 takes into consideration the complex relationship between correct function, user comfort, bump shape, bump density relative to cushion density, and bump height relative to the height of the cushion.

Figure 2:
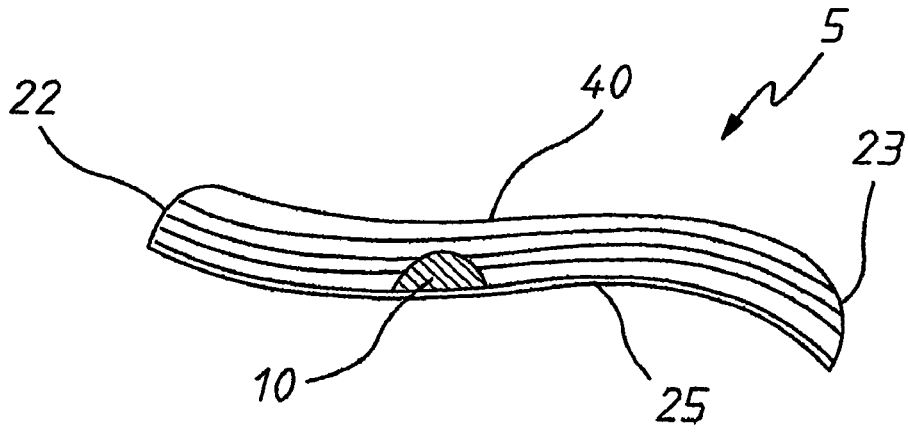

As best shown in FIGS. 1 and 2, the speed bump 10 lies below a top surface 40 of the seat 5, allowing good pressure distribution in normal seating position. It is preferred that the material of the front and rear seat portions 15, 20 have the same density and are integrally formed. This material could be polyurethane foam. However, any suitable material can be used. It is also conceived that the seat 5 could be adjustable to accommodate the requirements and body types of different users.

Figure 3:
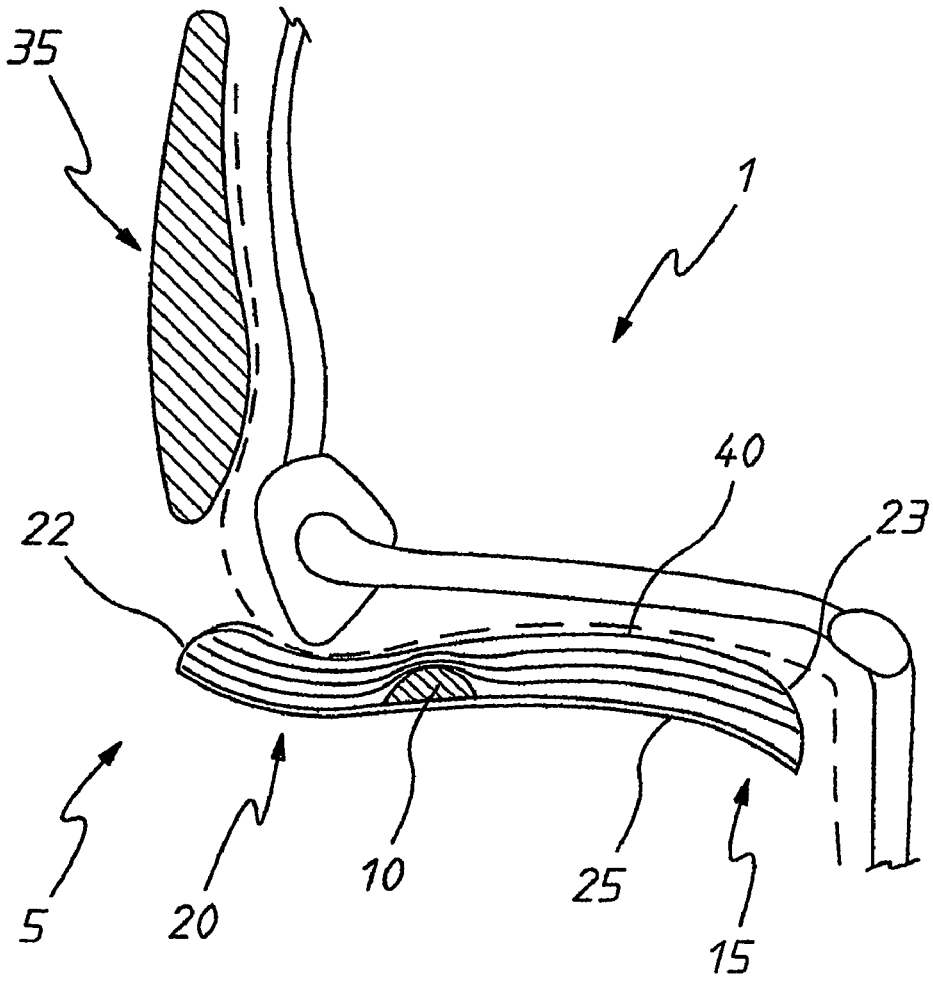
FIG. 3 shows a skeletal structure of a human when sitting on the seat of FIG. 2.

In use and as best seen in FIG. 3, when seated, the user's buttocks and ischial tuberosities compress the material, such as foam, in the rear seat portion 20. If the user begins to slide forward (into a poor posture position), the speed bump 10 causes a rapid increase in the density of that foam preventing any further forward slide. As the increase in density is less comfortable, the user will naturally tend to move to the back edge 22 of the seat 5, further improving pelvic and spinal alignment.

The chair 1 should further include a properly supportive backrest 35 which encourages slight lordosis of the lumbar spine (the apex of lumbar support should be located at the L4 vertebrae) and slight kyphosis of the thoracic spine leading to what is known as the "neutral" spine alignment. The ideal backrest design should also discourage side bent posture and a pelvic instability by encouraging closure of the sacroiliac joint.

Although the invention has been described with reference to specific examples, it would be appreciated by those skilled in the art that the invention may be embodied in many other forms.

The invention claimed is:

1. A chair including:

a seat with a base having a front edge and a rear edge; and a back rest extending upwardly from about the rear edge of the base;

the seat including:

a front seat portion of resilient material attached to the base, a rear seat portion of resilient material attached to the base, and a barrier member extending transversely across the base and upwardly from the base between the front and rear seat portions so as to be located closer to said rear edge relative to said front edge, the barrier member having a density greater than the density of the front and rear seat portions, wherein the barrier member is a ridge extending longitudinally across a width of the seat and being located rearward of the said front edge towards the said rear edge so as to provide a desired position of a user's buttocks; and whereby, in use, movement of said user's buttocks from the rear seat portion towards the front seat portion urges the rear seat portion towards the barrier member under the user's weight, deforming the rear seat portion and inhibiting the buttocks from moving towards the front seat portion.

2. The chair according to claim 1, wherein the front and rear seat portions are of the same density.

3. The chair according to claim 1, wherein the barrier member is a molded part of the base of the seat.

4. The chair according to claim 1, wherein the barrier member is 40 to 100 mm wide.

5. The chair according to claim 1, wherein the barrier member is located below a top surface of a seat cushion including the front and rear seat portions.

6. The chair according to claim 1, wherein the seat is substantially horizontally oriented.

* * * * *